US006070328A

United States Patent [19]

Hasegawa

[11] Patent Number: 6,070,328

[45] Date of Patent: Jun. 6, 2000

[54] SCISSORS

[75] Inventor: Yoshinobu Hasegawa, Seki, Japan

[73] Assignee: Hasegawa Hamono Kabushiki Kaisha, Gifu-ken, Japan

[21] Appl. No.: 08/929,191

[22] Filed: Sep. 8, 1997

Related U.S. Application Data

[63] Continuation of application No. 08/690,537, Jul. 31, 1996, Pat. No. 5,749,147.

[51] Int. Cl.[7] ..... B26B 13/00

[52] U.S. Cl. ..... 30/134; 30/1.5

[58] Field of Search ..... 30/134, 1.5, 443, 30/446, 234, 297, 223, 256, 254

[56] References Cited

U.S. PATENT DOCUMENTS

| | | | |
|---|---|---|---|
| 1,322,085 | 11/1919 | Bertrand | 30/134 |
| 1,604,004 | 10/1926 | Warner | 30/134 |
| 4,246,698 | 1/1981 | Lasner et al. | 30/134 |
| 4,897,921 | 2/1990 | Ramun | 30/134 |
| 5,384,962 | 1/1995 | Pemberton | 30/134 |
| 5,461,784 | 10/1995 | Baron | 30/135 |

FOREIGN PATENT DOCUMENTS

| | | |
|---|---|---|
| 17 79 106 | 6/1958 | Germany . |
| 295 12 520 U1 | 11/1995 | Germany . |
| 5-8850 | 7/1930 | Japan . |
| 13-9840 | 7/1938 | Japan . |
| 53-35489 | 9/1976 | Japan . |
| 61-75261 | 5/1986 | Japan . |
| 1-99364 | 7/1989 | Japan . |

*Primary Examiner*—Douglas D. Watts
*Attorney, Agent, or Firm*—Crompton, Seager & Tufte, LLC

[57] ABSTRACT

Scissors has a first scissor member and a second scissor member which are pivotally coupled to each other. The scissors comprises a blade formed with and extetending along at least one of the scissor members and a fastening memeber is provided with at least a tip portion of the other one of the scissor members to fasten the associated sciccor member to a material to be cut.

19 Claims, 9 Drawing Sheets

SCISSORS

This is a continuation of application Ser. No. 08/690,537 filed on Jul. 31, 1996 now U.S. Pat. No. 5,749,147.

BACKGROUND OF THE INVENTION

1. Field of the Invention

This invention relates to a pair of scissors that is used for cutting things made of slippery material.

2. Description of the Related Art

Recent concern about waste treatment and the environment has highlighted the necessity of recycling. This trend has resulted in an increased number of collected drink containers.

Among the collected containers are glass bottles, which break down into two groups: returnable bottles, which are reused in the original form after being washed, and one-way bottles, which are molded in predetermined shapes after being crushed and dissolved.

Recycling the returnable bottles is relatively easy, while recycling the one-way bottles is burdensome since it requires a molding process. In the molding process, things that are attached to the bottle, such as metal caps and resin spouts, need to be removed. This is because dissolving glass with other materials may result in crazing or undesirable color in the molded products (bottles).

While removing a metal cap from a bottle is relatively easy, a resin spout, which is usually firmly attached to a bottle and has a slippery surface, needs to be cut by a knife or melted before being removed from the bottle.

Incidentally, considerable number of glass bottles used as drink containers have been replaced with PET bottles. PET bottles are not efficiently recycled and most of them are just thrown away in dumping grounds as non-flammable garbage. In some districts, PET bottles are collected as flammable garbage. The bottles are then incinerated in garbage-processing center and thrown away in dumping grounds. PET bottles take much space in dumping grounds and garbage-processing centers because of their bulkiness. Individual consumers can reduce the space required for PET bottles in dumping grounds and garbage-processing centers simply by cutting PET bottles into pieces before throwing them away.

However, being relatively hard and having slippery surface, PET bottles cannot be cut with ordinary scissors. Cutting a PET bottle with a cutter, if possible, is difficult.

SUMMARY OF THE INVENTION

It is an object of the present invention to provide a pair of scissors that facilitate cutting of things made of slippery materials.

To achieve the above object, scissors has a first scissor member and a second scissor member which are pivotally coupled to each other. The scissors comprises a blade formed with and extetending along at least one of the scissor members and a fastening memeber is provided with at least a tip portion of the other one of the scissor members to fasten the associated sciccor member to a material to be cut.

BRIEF DESCRIPTION OF THE DRAWINGS

The features of the present invention that are believed be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
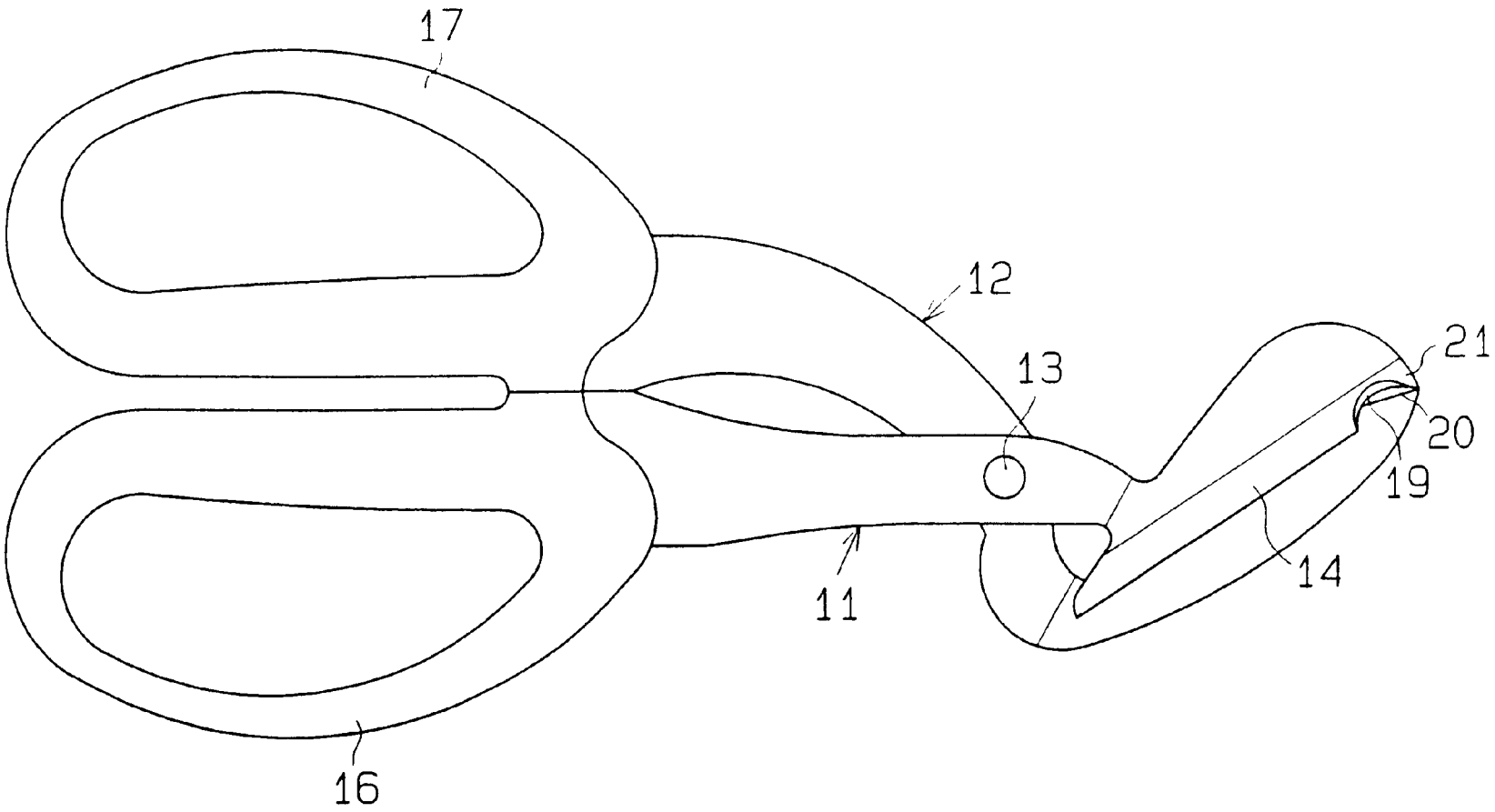
FIG. 1 is a front view of a pair of scissors according to an embodiment of the present invention.
Figure 2:
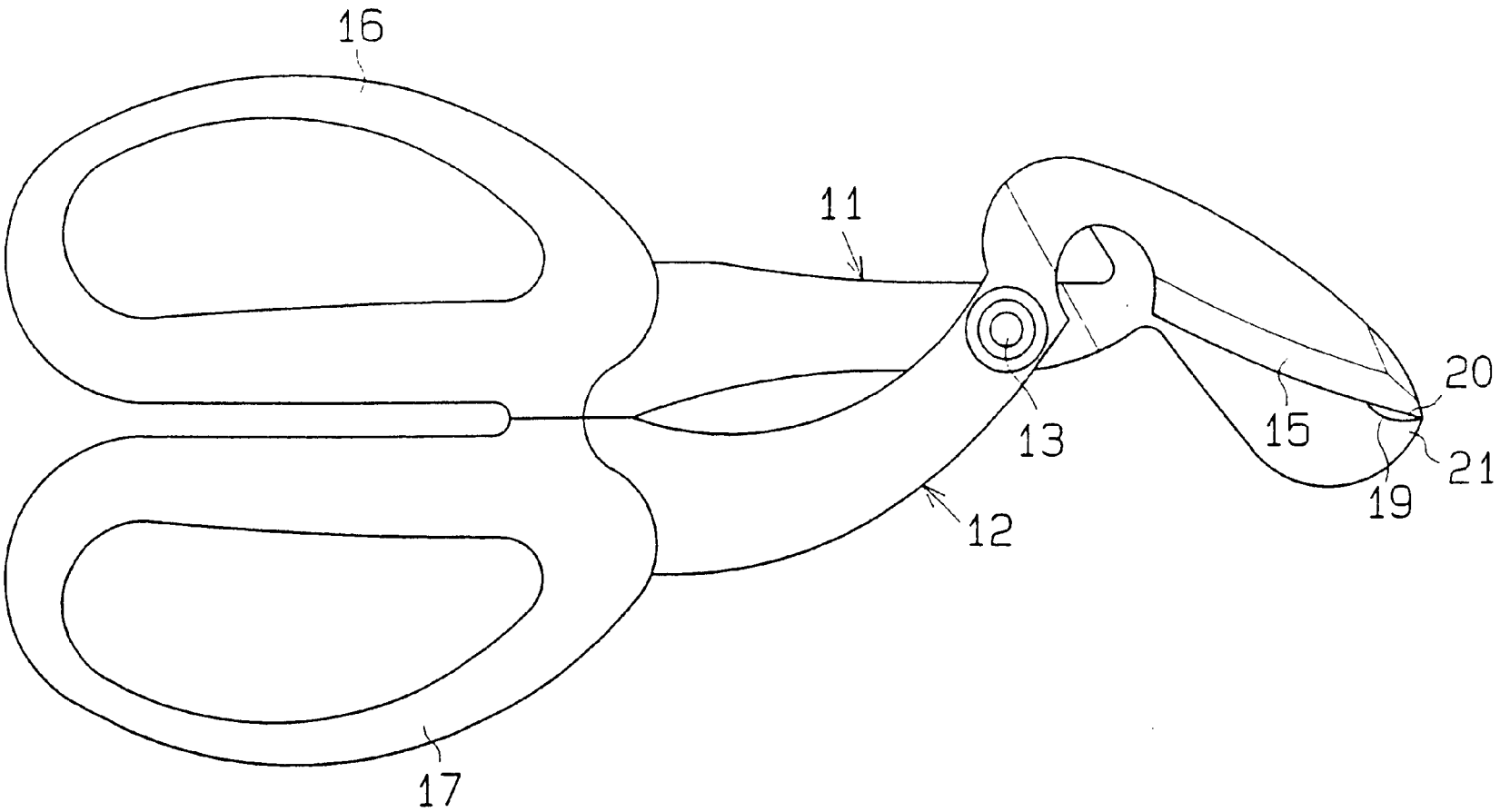
FIG. 2 is rear view of the scissors shown in FIG. 1.
Figure 3A:
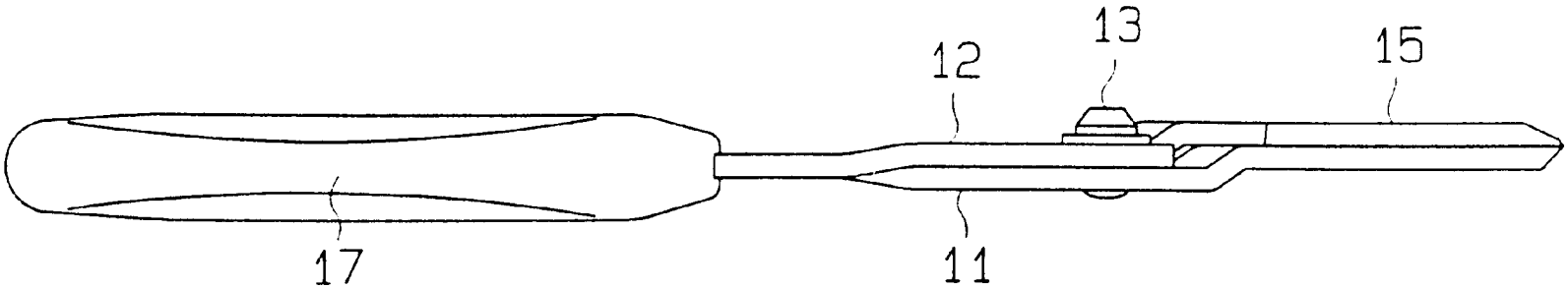
FIG. 3A is a side view of the scissors seen from the top side of FIG. 1.
Figure 3B:
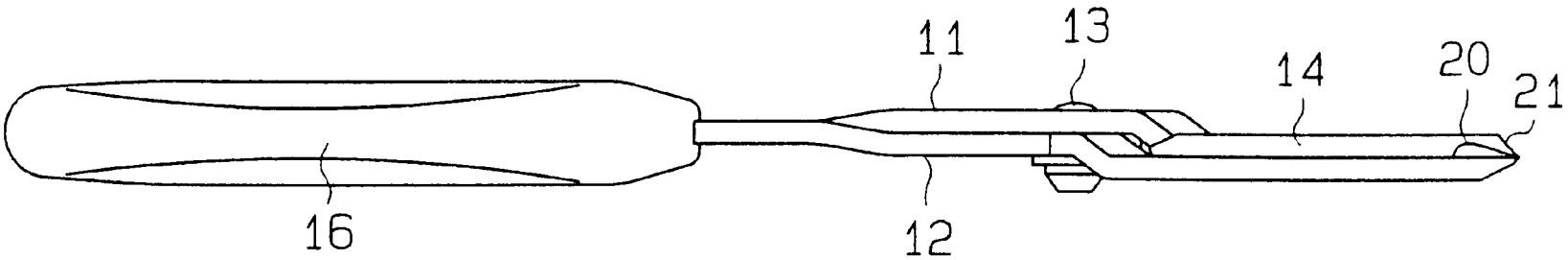
FIG. 3B is a side view of the scissors seen from the bottom side of FIG. 1.

Scissors that embody the present invention will be described below in detail referring to the drawings.

As shown in FIGS. 1 to 3B, a first scissor member 11 and a second scissor member 12 are pivotably connected by a pivot 13. Blades 14 and 15 are formed at first ends of the scissor members 11 and 12, respectively. Handles 16 and 17 are attached to second ends of the scissor members 11 and 12, respectively.

A notch 20 is formed next to a point of the blade 14 on the blade 14. The notch 20, together with an end of the blade 14, defines a claw 21 as an engaging means. The claw 21 is pointed in a direction approximately perpendicular to the edge of the blade 14. An edge 19 is formed on the notch 20.

Figure 4:
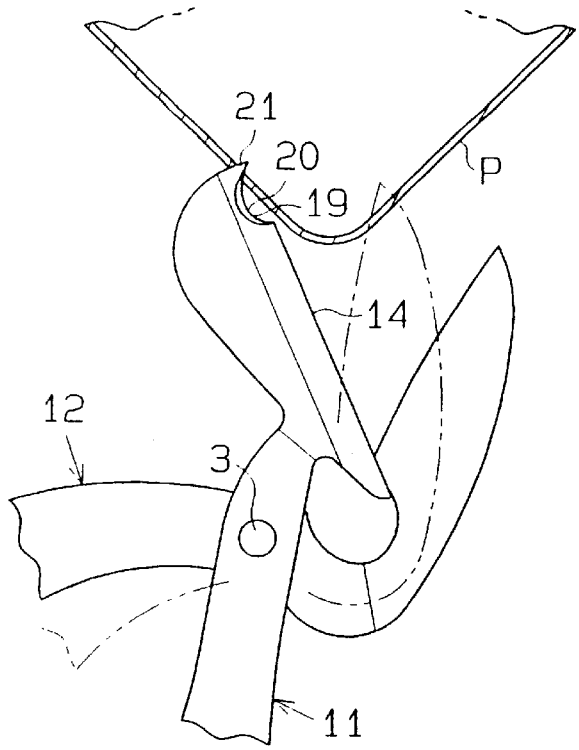
FIG. 4 is a diagram illustrating the operation of the scissors shown in FIG. 1.

The operation of the above scissors when cutting a PET bottle will now be described. The scissor members 11 and 12 are spread apart. Then the claw 21 is pierced into a wall of a PET bottle P as shown in FIG. 4. This engages an end of the scissor member 11 with the bottle P and fixes it with respect to the bottle P. Then the scissor members 11 and 12 are closed. This inserts an end of the blade 15 of the second scissor member 12 into the bottle P. A further closing of the scissor members 11 and 12 allows the edge 19 formed on the notch 20 of the first scissor member 11 and the blade 15 of the second scissor member 12 to work together to cut a part of the surface of the bottle P to form an opening.

After being removed from the opening temporarily, the second scissor member 12 is inserted into the bottle P through the opening. Then opening and closing of the scissor members further cut the bottle P.

In the present invention, the claw 21 is provided for engaging the blade 14 of the first scissor member 11 in the wall of the PET bottle P. This restricts the movement of the scissor member 11 with respect to the surface of the bottle P when cutting the bottle P, and this prevents the scissor member 11 from sliding on the surface of the bottle P. The notch 20 formed next to the claw 21 on the edge 14 of the first scissor member 11 allows the claw 21 to be inserted deeply into the surface of the bottle P.

Furthermore, the claw 21 is oriented perpendicular to the edge of the blade 14. In other words, the claw 21 extends approximately perpendicular to the direction in which the blade 14 slides with respect to the bottle P. This restricts the movement of the first scissor member 11 with respect to the bottle P, facilitating cutting of slippery bottle material.

It is noted that the scissors may be used for cutting aluminum cans, cartons of milk, etc. in addition to the PET bottle.

Figure 5A:
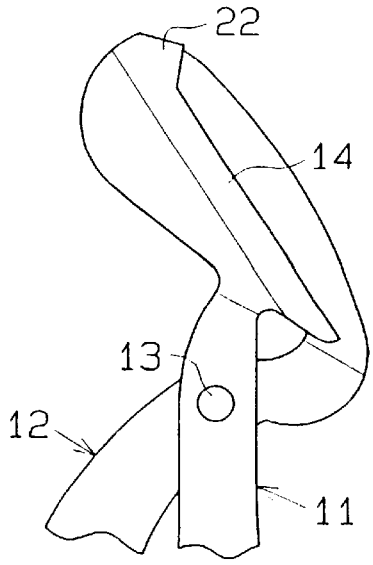
FIG. 5A is a partial front view of a pair of scissors according to another embodiment of the present invention.

Although only one embodiment of the present invention has been described so far, it should be apparent to those skilled in the art that the present invention may be embodied in many other specific forms without departing from the spirit or scope of the invention. Particularly, the invention may be embodied in the following forms:

(1) Instead of forming the notch 20 to define the claw 21 which extends toward the blade 15, a claw 22 may be formed on the blade 14 by forming a projection as shown in FIG. 5A.

Figure 5B:
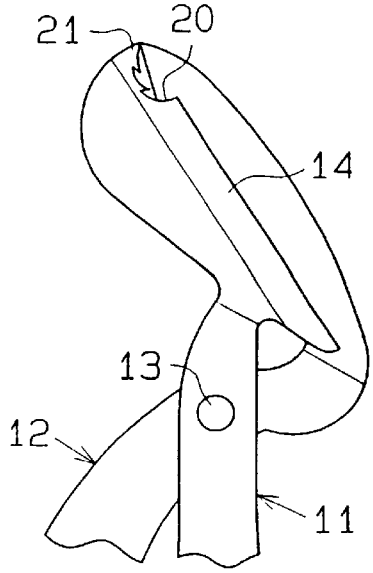
FIG. 5B is a partial front view of a pair of scissors according to another embodiment of the present invention.

(2) The notch 20 may have a serrated edge as shown in FIG. 5B. This design prevents the claw 21 from coming off the bottle P when inserted therein.

Figure 6A:
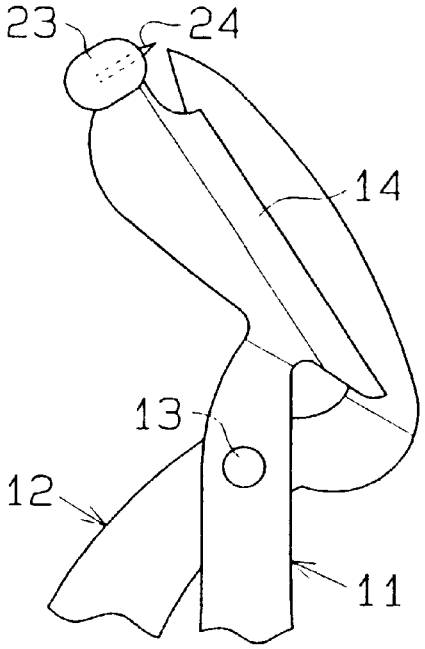
FIG. 6A is a partial front view of a pair of scissors having a needle.

(3) The claw 21 may be replaced with:

As shown in FIG. 6A, a needle 24 may be used. The needle 24 is inserted in a resin joint 23, which is attached to the blade 14 by inserting the point of the blade into the joint. The needle 24 protrudes perpendicularly to the edge of the blade 14.

Figure 6B:
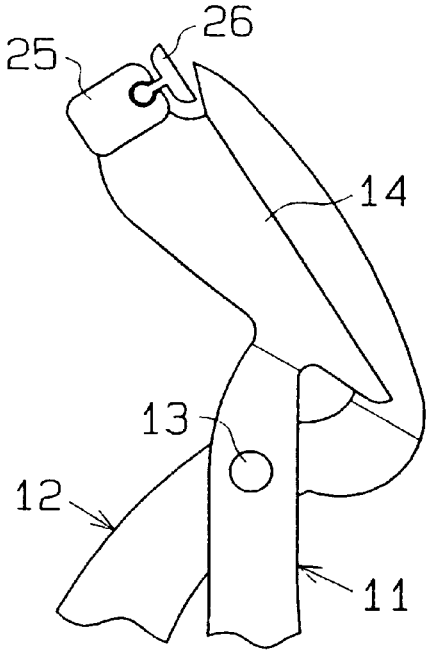
FIG. 6B is a partial front view of a pair of scissors having a suction cup.

As shown in FIG. 6B, a suction cup 26 may be attached to the blade 14. The proximal end of the suction cup 26 is pivotally supported by a resin joint 25. The suction cup 26 has axis perpendicular to the edge of the blade 14.

Figure 6C:
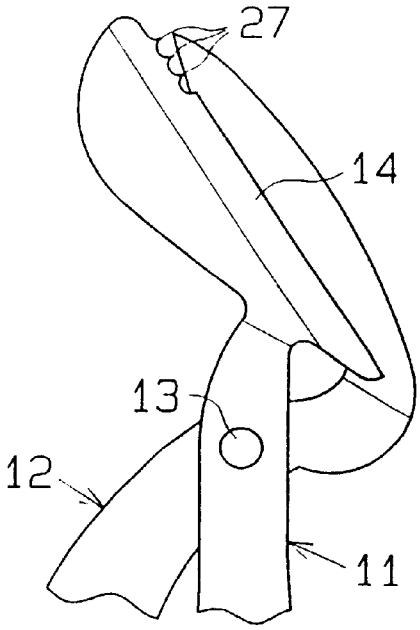
FIG. 6C is a partial front view of a pair of scissors having claws.

(4) A plurality of claws 27 protruding toward the blade 15 may be formed at an end of the first scissor member 11 on the blade 14 as shown in FIG. 6C.

Figure 12:
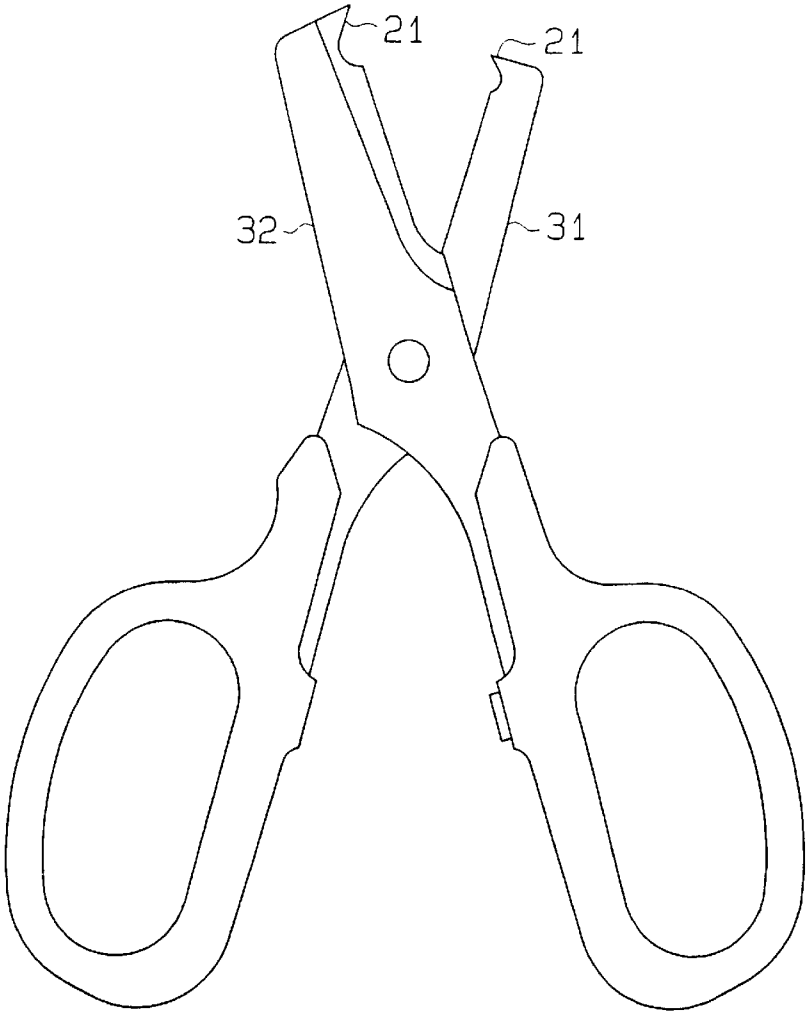
FIG. 12 a front view of a pair of scissors according to another embodiment of the present invention, in which claws are formed on both of the scissor members.

(5) As shown in FIG. 12, the claw 21 may be formed on the first and second scissor members, respectively. This enables the end of the both scissor members 31 and 32 to be inserted into the bottle P.

Figure 7:
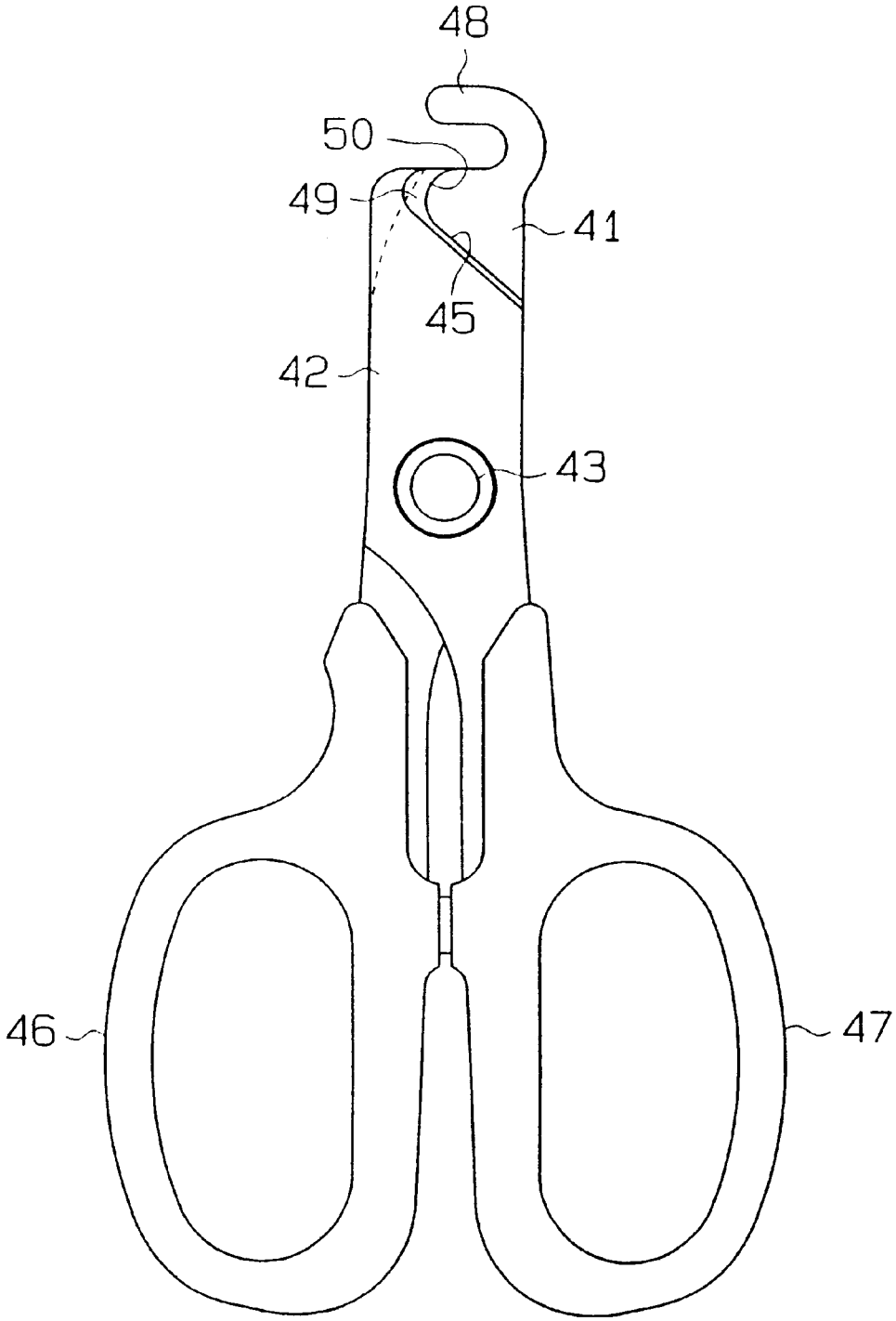
FIG. 7 is a front view of a pair of scissors for cutting the spout of a bottle in the closed state.
Figure 8:
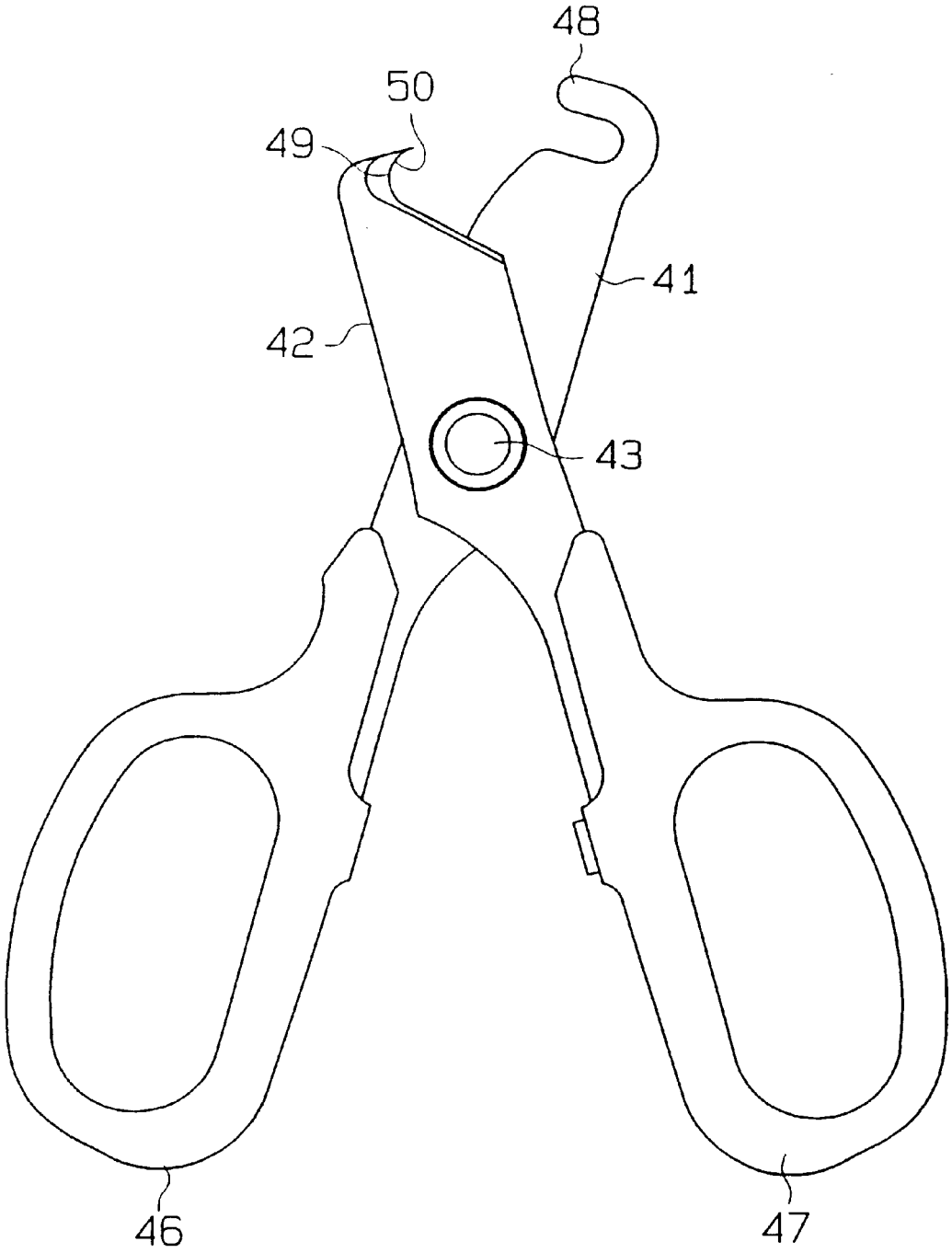
FIG. 8 is a front view of the scissors shown in FIG. 7 in the spread state.

(6) The pair of scissors described in the first embodiment is designed for cutting a PET bottle P. However, the present invention may be embodied in scissors for removing a resin spout attached to a bottle. As shown in FIGS. 7 to 8, a first scissor member 41 and a second scissor member 42 are pivotably connected to each other by a pivot 43. Handles 46 and 47 are attached to ends of the scissor members 41 and 42, respectively. The distal end of the first scissor member 41 extends further than that of the second scissor member 42. The extended part of the first scissor member 41 has a U-shaped hook 48. The hook 48 opens toward the second scissor member 42. The first scissor member 41 has no blade, while the second scissor member 42 has a blade 49 having a sharper angle than blades of ordinary scissors. A notch 50, which opens toward the hook 48, is formed on the blade 49 at the end of the second scissor member 42.

Figure 9:
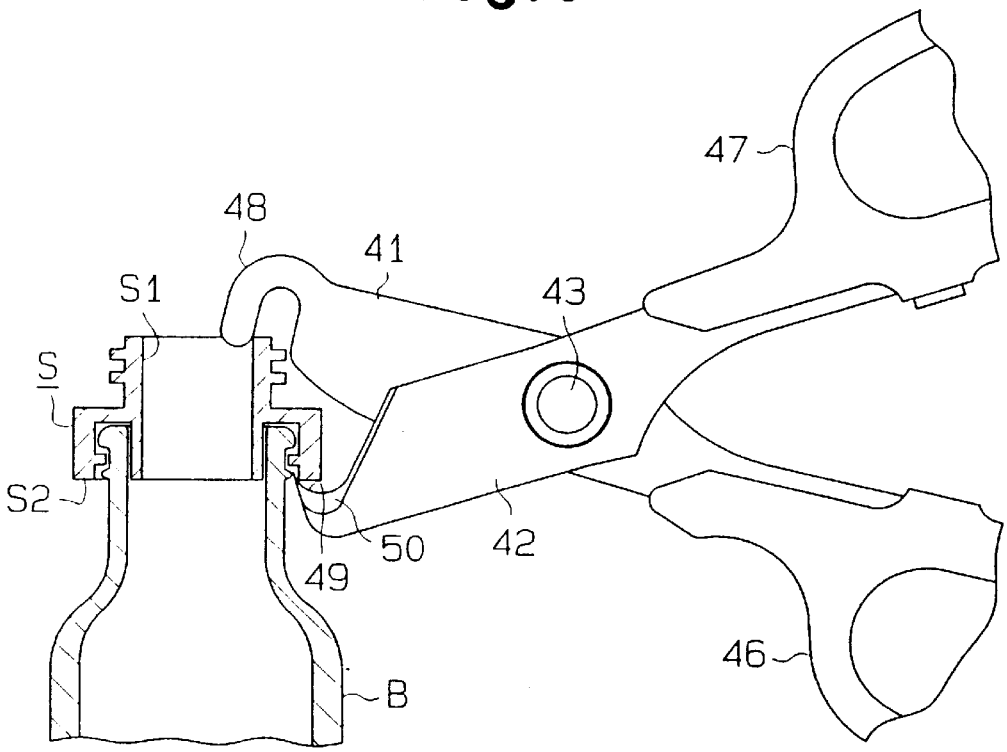
FIG. 9 is a front view of the scissors shown in FIG. 7 with the hook and the slot hooked to the spout of a bottle.
Figure 10:
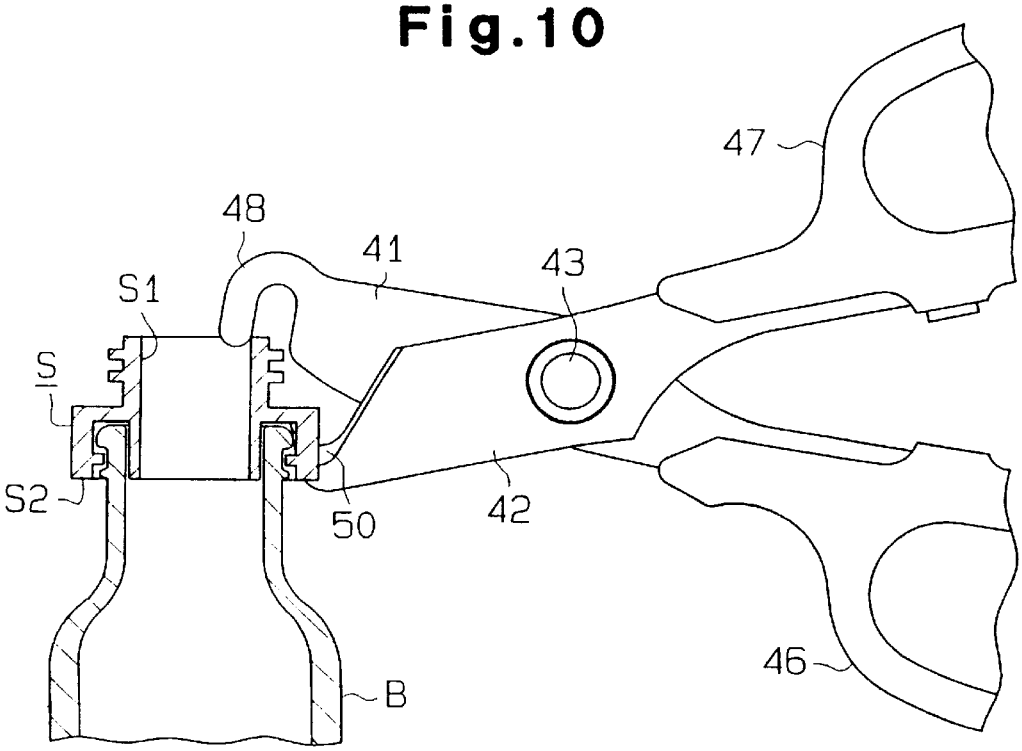
FIG. 10 is a front view of the scissors closed from the state in FIG. 9.

The operation of the above described scissors for removing a resin spout will now be described with reference to FIGS. 9 and 10. First, the scissor members 41 and 42 are spread. The hook 48 of the first scissor member 41 is hooked to the opening S1 of the spout S. Then the notch 50 of the second scissor member 42 is also hooked to the lower end S2 of the spout S by closing the scissor members 41 and 42. A further closing of the scissors does not move the hook 48 into the spout S since the hook has no edge, while allowing the blade 49 of the second scissor member 42 to cut the spout S from the lower end toward the top as shown in FIG. 10.

Figure 11:
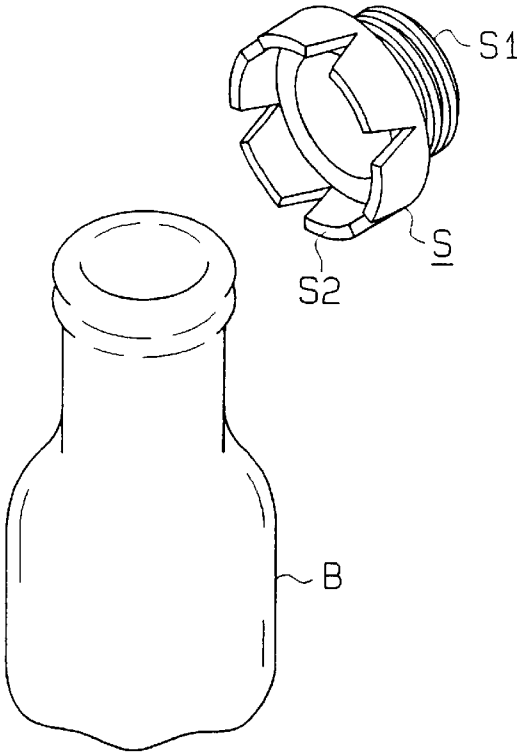
FIG. 11 is a perspective view of a bottle and a cut spout removed from the bottle.

The above operation is repeated several times for forming a plurality of rifts on the periphery of the spout S. as illustrated in FIG. 11. This disables the attachment of the spout S to the bottle B, allowing the spout S to be removed by a hand.

The scissors of FIG. 7 may also be formed without the notch 50 in the second scissor member 42. That is, the blade 49 may be formed in a straight manner. As long as the hook 48 is provided with the first scissor member 41, the blade of the second scissor member 42 functions to form the rifts in the same manner as illustrated in FIGS. 9 and 10.

Therefore, the present examples and embodiments are to be considered as illustrative and not restrictive and the invention is not to be limited to the details given herein, but may be modified within the scope of the appended claims.

What is claimed is:

1. A pair of scissors for cutting stiff, sheet-like material comprising:

a first scissor member having a blade, wherein the blade has a substantially linear sharpened edge; and a second scissor member pivotally connected to the first scissor member, the second scissor member having a sharp claw near its distal end, wherein the shape of the claw is defined by an arcuate recess formed in the second scissor member, the sharp claw having a leading edge capable of piercing the material when the scissors are open, wherein the claw leading edge points generally toward the blade of the first scissor member, wherein the blade cuts the material substantially proximal of the claw after the claw has been anchored when the scissors are pivoted toward their closed position.

2. The scissors according to claim 1, wherein the arcuate recess has a sharpened edge.

3. The scissors according to claim 1, wherein each of the first and second scissor members has a distal tip, and wherein the distal tips contact one another when the scissors are closed.

4. The scissors according to claim 1, wherein the second scissor member includes a blade proximal of the claw.

5. The scissors according to claim 1, wherein at least one sharp projection extends from the second scissor member proximal of the claw.

6. The scissors according to claim 1, wherein the second scissor member has serrations proximal of the claw.

7. A pair of scissors for cutting stiff, sheet-like material comprising:

a first scissor member having a blade, wherein the blade has a substantially linear sharpened edge; and a second scissor member pivotally connected to the first scissor member, the second scissor member having a sharp claw near its distal end, the sharp claw having a leading edge capable of piercing the material when the scissors are open, wherein the claw leading edge points generally toward the blade of the first scissor member, wherein the blade cuts the material substantially proximal of the claw after the claw has been anchored when the scissors are pivoted toward their closed position, wherein the claw is formed by a needle extending from the second scissor member.

8. The scissors according to claim 1, wherein the second scissor member has a cutting edge defining a line and the claw leading edge extends at least to the cutting edge line.

9. A pair of scissors for cutting stiff, sheet-like material comprising:

a first scissor member;

a second scissor member pivotally connected to the first scissor member;

a blade portion disposed on either of the first or second scissor members; and a sharp claw located at the distal end of the second scissor member, the shape of the claw being defined by an arcuate recess formed in the second scissor member, wherein the claw is capable of piercing the material when the scissors are open and capable of anchoring the second scissor member to the material, wherein the blade portion cuts the material substantially proximal of the claw when the scissors are pivoted toward their closed position after the claw has been anchored.

10. The scissors according to claim 9, wherein the sharp claw points generally in a direction that is perpendicular to a longitudinal axis of the second scissor member.

11. The scissors according to claim 9, wherein the arcuate recess has a sharpened edge.

12. The scissors according to claim 9, wherein the blade portion is disposed on the second scissor member proximal of the claw.

13. The scissors according to claim 9, wherein at least one sharp projection extends from the second scissor member proximal of the claw.

14. The scissors according to claim 9, wherein the blade portion is disposed on the second scissor member and has serrations proximal of the claw.

15. The scissors according to claim 9, wherein the second scissor member has a cutting edge defining a line and the claw extends at least to the cutting edge line.

16. A pair of scissors for cutting stiff, sheet-like material comprising:

a first scissor member, the first scissor member having a sharpened edge extending to the distal end of the first scissor member;

a second scissor member pivotally connected to the first scissor; and a sharp claw located at the distal end of the second scissor member, the shape of the claw being defined by an arcuate recess formed in the second scissor member, wherein the sharp claw is constructed and arranged to pierce the material when the scissors are open to anchor the second scissor member to the material, and wherein the sharpened edge cuts the material when the scissors are pivoted toward their closed position after the sharp claw has been anchored.

17. The scissors according to claim 16, wherein the sharp claw points generally in a direction that is perpendicular to a longitudinal axis of the second scissor member.

18. The scissors according to claim 16, wherein the arcuate recess has a sharpened edge.

19. The scissors according to claim 16, wherein the second scissor member has an inside edge defining a line and the claw extends at least substantially to the inside edge line.

* * * * *

UNITED STATES PATENT AND TRADEMARK OFFICE

CERTIFICATE OF CORRECTION

PATENT NO : 6,070,328

DATED : June 6, 2000

INVENTOR(S) : Yoshinobu Hasegawa

It is certified that error appears in the above-identified patent and that said Letters Patent are hereby corrected as shown below:

Foreign Application Priority Data:

Japanese Application No. 8-107023, filed April 26, 1996
Japanese Application No. 8-139074, filed May 31, 1996

Signed and Sealed this

Eighth Day of May, 2001

*Attest:*

Nicholas P. Godici

NICHOLAS P. GODICI

*Attesting Officer*

*Acting Director of the United States Patent and Trademark Office*